US009879889B2

(12) United States Patent
Wait

(10) Patent No.: US 9,879,889 B2
(45) Date of Patent: Jan. 30, 2018

(54) REFRIGERATOR APPLIANCES WITH MOVABLE INDIVIDUALLY TEMPERATURE CONTROL BINS

(71) Applicant: General Electric Company, Schenectady, NY (US)

(72) Inventor: Keith Wesley Wait, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 751 days.

(21) Appl. No.: 14/338,597

(22) Filed: Jul. 23, 2014

(65) Prior Publication Data

US 2016/0025388 A1 Jan. 28, 2016

(51) Int. Cl.

| | |
|---|---|
| ***F25D 25/00*** | (2006.01) |
| ***F25B 21/04*** | (2006.01) |
| ***F25D 25/02*** | (2006.01) |

(52) U.S. Cl.

CPC ..... *F25B 21/04* (2013.01); *F25D 25/025* (2013.01); *F25B 2321/021* (2013.01); *F25D 2700/121* (2013.01)

(58) Field of Classification Search

CPC ..... F25B 21/02; F25B 21/04; F25D 25/022; F25D 25/025

See application file for complete search history.

(56) References Cited

U.S. PATENT DOCUMENTS

| | | | | |
|---|---|---|---|---|
| 7,000,407 | B2 | 2/2006 | Miozza et al. | |
| 2008/0168795 | A1* | 7/2008 | Alfille | F25D 11/00 62/457.9 |
| 2012/0304667 | A1* | 12/2012 | Shin | F25B 21/02 62/3.6 |
| 2013/0276465 | A1* | 10/2013 | Shin | F25B 21/02 62/3.6 |

FOREIGN PATENT DOCUMENTS

| | | |
|---|---|---|
| CN | 101867232 A | 10/2010 |
| JP | 2003307376 A | 10/2003 |

OTHER PUBLICATIONS

Texas Instruments, "Automotive, Free Positioning, Qi Compliant Wireless Power Transmitter Manager", bq500414Q Data Sheet, Jan. 2014 (revised Jun. 2014), 31 pages.

* cited by examiner

*Primary Examiner* — Jianying Atkisson
*Assistant Examiner* — Antonio R Febles
(74) *Attorney, Agent, or Firm* — Dority & Manning, P.A.

(57) ABSTRACT

Refrigerator appliance with movable individually temperature controlled bins are provided. One example refrigerator appliance includes one or more transmitter coils and one or more bins. Each of the one or more bins includes a temperature sensor positioned to read a temperature in a bin storage volume. Each of the one or more bins includes a receiver coil. The receiver coil receives power from one of the one or more transmitter coils through inductive power transfer. Each of the one or more bins includes a thermo- (Continued)

electric heat pump. The thermoelectric heat pump receives power from the receiver coil. The operation of the thermoelectric heat pump is controlled based on the temperature in the bin storage volume read by the temperature sensor, such that the temperature in the bin storage volume is maintained at a setpoint temperature associated with such bin.

4 Claims, 5 Drawing Sheets

REFRIGERATOR APPLIANCES WITH MOVABLE INDIVIDUALLY TEMPERATURE CONTROL BINS

FIELD OF THE INVENTION

The present disclosure relates generally to refrigerator appliances. In particular, the present disclosure is directed to refrigerator appliances with movable bins that feature individual temperature control.

BACKGROUND OF THE INVENTION

Refrigerator appliances can typically include two compartments: a fresh food compartment and a freezer compartment. The fresh food compartment may be maintained at a temperature that preserves food but is above freezing, while the freezer compartment is maintained at a temperature that is below freezing.

Thus, the user of a typical refrigerator appliance is only provided two options for temperature and other storage parameters when storing food items.

However, it has been shown that various foods have different optimal storage conditions. As an example, fresh produce items have different optimal storage parameters than meats or other food items.

As such, refrigerator appliances providing only two distinct temperature regions fail to provide adequate storage options to accommodate the full range of food products a typical user will store or refrigerate. Therefore, refrigerator appliances with movable bins that feature individual temperature control are desirable.

BRIEF DESCRIPTION OF THE INVENTION

Aspects and advantages of the invention will be set forth in part in the following description, or may be obvious from the description, or may be learned through practice of the invention.

One aspect of the present disclosure is directed to a refrigerator appliance. The refrigerator appliance includes one or more transmitter coils. The refrigerator appliance includes one or more bins. Each of the one or more bins includes a bin body. The bin body defines a bin storage volume. Each of the one or more bins includes a temperature sensor positioned to read a temperature in the bin storage volume. Each of the one or more bins includes a receiver coil. The receiver coil receives power from one of the one or more transmitter coils through inductive power transfer. Each of the one or more bins includes a thermoelectric heat pump. The thermoelectric heat pump receives power from the receiver coil. The operation of the thermoelectric heat pump is controlled based on the temperature in the bin storage volume read by the temperature sensor, such that the temperature in the bin storage volume is maintained at a setpoint temperature associated with such bin.

Another aspect of the present disclosure is directed to a bin for use in a refrigerator appliance. The bin includes a bin body. The bin body defines a bin storage volume. The bin includes an adjustable resistance device. The adjustable resistance device provides a first resistance that is adjustable to adjust a setpoint temperature associated with the bin. The bin includes a thermistor positioned within the bin storage volume. The thermistor provides a second resistance indicative of a temperature in the bin storage volume. The bin includes a receiver coil. The receiver coil is configured to receive power through inductive power transfer from a transmitter coil included in the refrigerator appliance. The bin includes a thermoelectric heat pump. The thermoelectric heat pump receives power from the receiver coil. Operation of the thermoelectric heat pump is controlled based at least in part on the first resistance and the second resistance so as to maintain the temperature in the bin storage volume at the setpoint temperature associated with the bin.

Another aspect of the present disclosure is directed to a refrigerator appliance. The refrigerator appliance includes one or more transmitter coils. The refrigerator appliance includes one or more bins. Each of the one or more bins includes a bin body. The bin body defines a bin storage volume. Each of the one or more bins includes a potentiometer. The potentiometer provides a first resistance between a wiper and a terminal of the potentiometer that is adjustable to adjust a setpoint temperature associated with the bin. Each of the one or more bins includes a thermistor positioned within the bin storage volume. The thermistor provides a second resistance indicative of a temperature in the bin storage volume. Each of the one or more bins includes a receiver coil. The receiver coil is configured to receive power through inductive power transfer from a transmitter coil included in the refrigerator appliance. Each of the one or more bins includes a thermoelectric heat pump. The thermoelectric heat pump receives power from the receiver coil. Operation of the thermoelectric heat pump is controlled based at least in part on the first resistance and the second resistance so as to maintain the temperature in the bin storage volume at the setpoint temperature associated with the bin.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
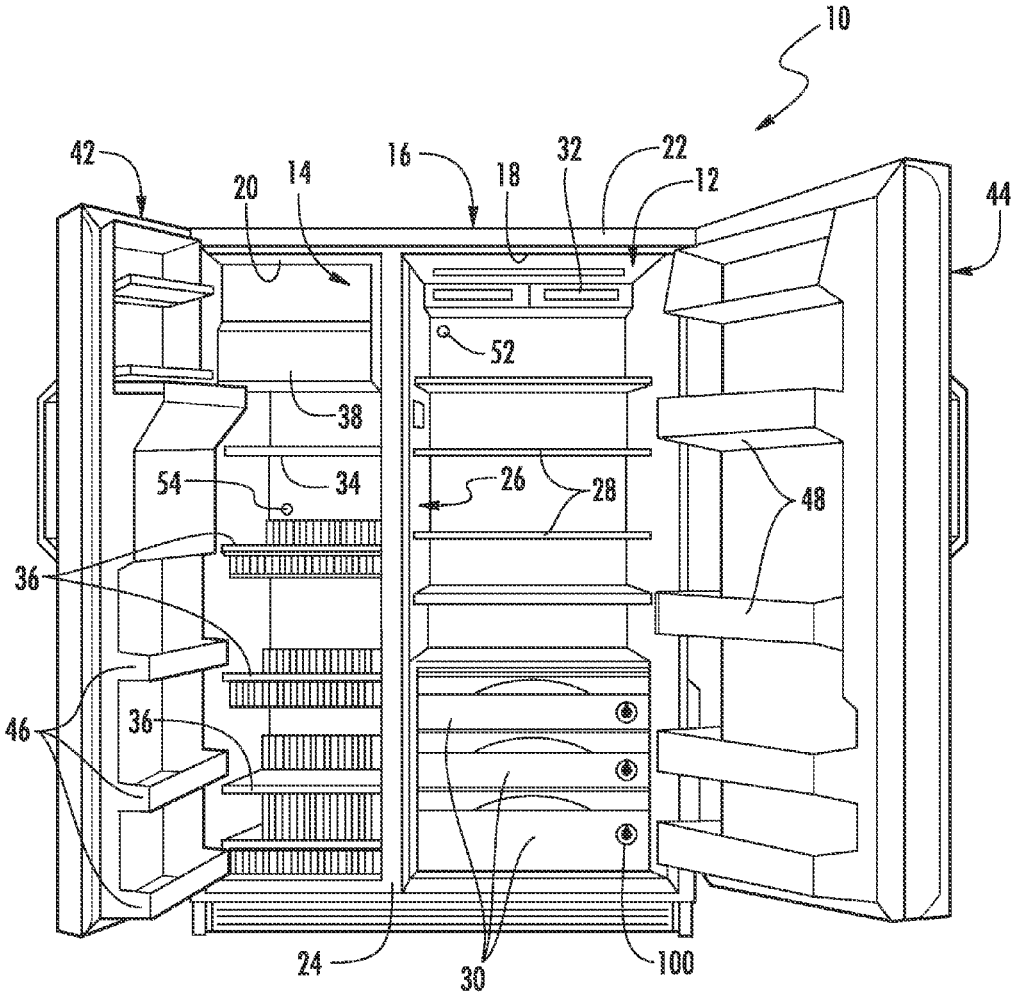
FIG. 1 depicts an example refrigerator appliance according to an example embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front, elevation view of a refrigerator appliance 10 according to an exemplary embodiment of the present subject matter. More specifically, for illustrative purposes, the present subject matter is described with refrigerator appliance 10 having a construction as shown and described further herein.

As used herein, "refrigerator appliance" includes appliances such as a refrigerator/freezer combination, side-by-side, bottom mount, compact, and any other style or model of refrigerator appliance. Accordingly, other configurations including multiple and different styled compartments could be used with refrigerator appliance 10, it being understood that refrigerator appliance 10 shown in FIG. 1 is provided by way of example only.

Refrigerator appliance 10 includes a fresh food storage compartment 12 and a freezer storage compartment 14. Freezer compartment 14 and fresh food compartment 12 are arranged side-by-side within a cabinet or housing that includes an outer case 16 and inner liners 18, 20. Freezer compartment 14 and fresh food compartment 12 are defined by inner liners 18 and 20 within outer case 16. A space between case 16 and liners 18 and 20, and between liners 18 and 20, is filled with foamed-in-place insulation. Outer case 16 normally is formed by folding a sheet of a suitable material, such as pre-painted steel, into an inverted U-shape to form the top and side walls of case 16. A bottom wall of case 16 normally is formed separately and attached to the case side walls and to a bottom frame that provides support for refrigerator appliance 10. Inner liners 18 and 20 are molded from a suitable plastic material to form freezer compartment 14 and fresh food compartment 12, respectively. Alternatively, liners 18, 20 may be formed by bending and welding a sheet of a suitable metal, such as steel.

A breaker strip 22 extends between a case front flange and outer front edges of liners 18, 20. Breaker strip 22 is formed from a suitable resilient material, such as an extruded acrylo-butadiene-styrene based material (commonly referred to as ABS). The insulation in the space between liners 18, 20 is covered by another strip of suitable resilient material, which also commonly is referred to as a mullion 24. In one embodiment, mullion 24 is formed of an extruded ABS material. Breaker strip 22 and mullion 24 form a front face, and extend completely around inner peripheral edges of case 16 and vertically between liners 18, 20. Mullion 24, insulation between compartments, and a spaced wall of liners separating compartments, sometimes are collectively referred to herein as a center mullion wall 26.

According to an aspect of the present disclosure, one or more transmitter coils can be embedded or otherwise positioned within a rear wall of the refrigerator appliance 10. For example, the transmitter coils can be positioned between inner liners 18 and 20 and outer case 16. In other embodiments, the transmitter coils can be embedded within the mullion 24 or other locations. In yet other embodiments, the transmitter coils can be positioned within the interior of fresh food storage compartment 12 or freezer storage compartment 14. For example, the transmitter coils can be mounted to the rear wall of refrigerator appliance 10 within fresh food storage compartment 12. The transmitter coils can be used to power one or more movable, individually temperature controlled bins using inductive power transfer, as will be discussed further herein.

A shelf 34 and wire baskets 36 are also provided in freezer compartment 14. In addition, an ice maker 38 may be provided in freezer compartment 14. A freezer door 42 and a fresh food door 44 close access openings to freezer and fresh food compartments 14, 12, respectively. Each door 42, 44 is mounted to rotate about its outer vertical edge between an open position, as shown in FIG. 1, and a closed position (not shown) closing the associated storage compartment. Freezer door 42 includes a plurality of storage shelves 46, and fresh food door 44 includes a plurality of storage shelves 48.

Refrigerator appliance 10 includes a machinery compartment that incorporates at least part of a sealed refrigeration system (not shown). The sealed refrigeration system includes various components for generating chilled air within the freezer and fresh food compartments 14, 12, such as a compressor 60 (FIG. 2) and an evaporator 62 (FIG. 3), as will be understood by those skilled in the art.

Refrigerator appliance 10 may further include one or more temperature sensors (e.g. at locations 52 and 54) for determining the respective temperatures within the fresh food compartment 12 and the freezer compartment 14. Feedback from the temperature sensors may be used to control the refrigeration system and other components such as fans to maintain desired set temperatures within the respective compartments.

As may be seen in FIG. 1, refrigerator appliance 10 includes shelves 28 and slide-out storage bins 30, sometimes referred to as storage pans or drawers, which normally are provided in fresh food compartment 12 to support items being stored therein. In some embodiments, bins 30 may be provided within freezer compartment 14 as well. Bins 30 can be mounted within fresh food compartment 12 using, for example, guide rails, shelving brackets, or other mounting devices. In some embodiments, bins 30 are easily movable to various different positions within the refrigerator appliance 10. For example, the bins can be removed and then re-inserted into a different mounting location.

Each of bins 30 can include a temperature control device 100. The temperature control device 100 can be manipulated by a user to adjust the local temperature within the bin 30, as will be discussed further herein. The temperature control device 100 can be a knob, slider, touchscreen, one or more buttons, or other control devices. The temperature control device 100 can be located on an exterior face of the bin 30 as shown in FIG. 1, or can be located in other positions (e.g. internal to the bin 30).

By modifying or adjusting the temperature level within each bin 30, food items within the bins 30 may keep longer or more uniformly. In particular, by providing individualized temperature control of bins 30, adequate storage options can be provided to accommodate the full range of food products a typical user will store or refrigerate.

Furthermore, although bins 30 are depicted as slide-out bins in FIG. 1, other styles of bins may be used as well to satisfy the present disclosure. For example, bins 30 can be secured in place and include one or more openings such as a door or can rotate or have other methods of access. In some embodiments, each of bins 30 is sealed so as to allow precise individual temperature control for each of such bins (e.g. by reducing air flow between the bin interior volume and the surrounding compartment).

Figure 2:
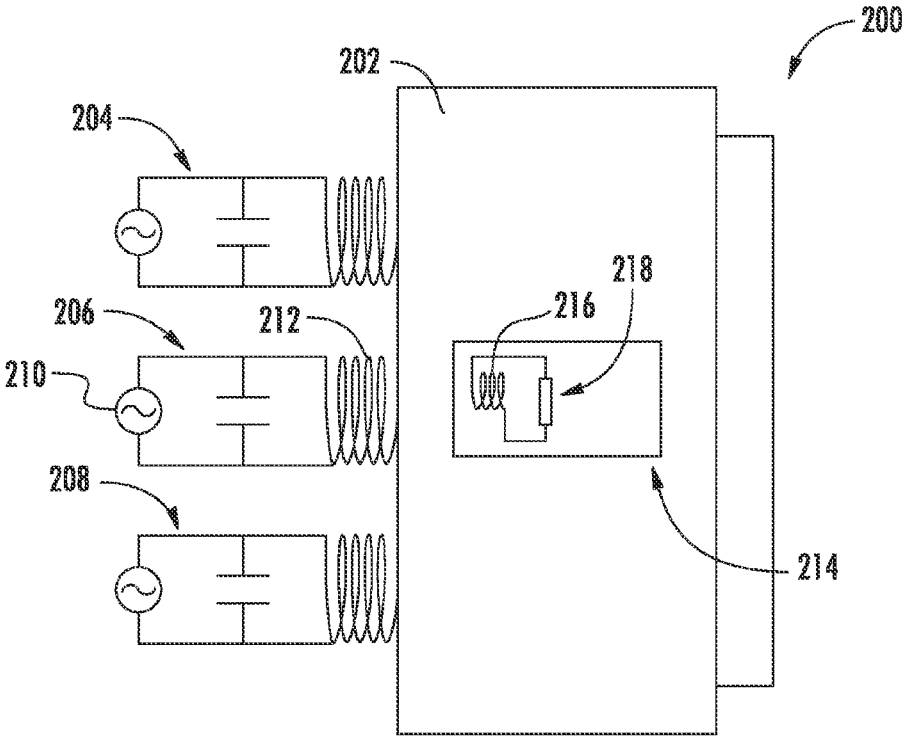
FIG. 2 depicts a simplified diagram of a refrigerator appliance according to an example embodiment of the present disclosure.

FIG. 2 depicts a simplified diagram 200 of a refrigerator appliance 202 according to an example embodiment of the present disclosure. In particular, diagram 200 depicts the plurality of transmitter coil assemblies 204, 206, and 208 positioned at different locations adjacent to a rear wall of the refrigerator appliance 202. For example, the transmitter coil assemblies can be embedded in the rear wall of refrigerator appliance 202 (e.g. between an outer case and an inner liner).

According to an aspect of the present disclosure, the transmitter coil assemblies (e.g. transmitter coil assembly 206) can provide power to a corresponding bin located within a refrigerator appliance 202. In particular, the transmitter coil assemblies can include a transmitter coil that transmits power to a receiver coil using inductive power transfer.

As an example, transmitter coil assembly 206 can include an alternating current power source 210. The alternating current power source 210 can supply alternating current power across a transmitter coil 212. The alternating current power source 210 can be provided by refrigerator appliance 202 according to known methods, including, for example, use of an inverter to transform direct current power into high-frequency alternating current power.

In some embodiments, the alternating current power provided to each transmitter coil assembly can be individually controlled, so that only transmitter coil assemblies for which a corresponding bin is positioned within the refrigerator appliance 202 are powered. For example, a ping technique can be used to determine the presence of a receiver coil adjacent to each transmitter coil. If a receiver coil is not located adjacent to a transmitter coil, then the alternating current power source for such transmitter coil can be de-energized. For example, transmitter coil assembly 206 may receive alternating current power while transmitter coil assemblies 204 and 208 do not receive power from refrigerator appliance 202.

Also shown in diagram 200 is a bin 214. Bin 214 can include a receiver coil 216. In particular, the flow of alternating current power across transmitter coil 212 can result in the generation of a magnetic field. The magnetic field can induce current flow through receiver coil 216. In such fashion, the electronic components included within bin 214 can be wirelessly powered through inductive power transfer.

The power received by receiver coil 216 can be used to power electronic components included within bin 214. In particular, a thermoelectric heat pump 218 can be electrically connected to the receiver coil 216. A heat pump control circuit can selectively energize the thermoelectric heat pump 218 to operate in a heating mode, a cooling mode, or neither a heating mode nor a cooling mode. As an example, the heat pump 218 can be operated so as to maintain a temperature within bin 214 near a setpoint temperature. The setpoint temperature can be adjustable by a user (e.g. by manipulating a temperature control device such as a knob).

Figure 8:
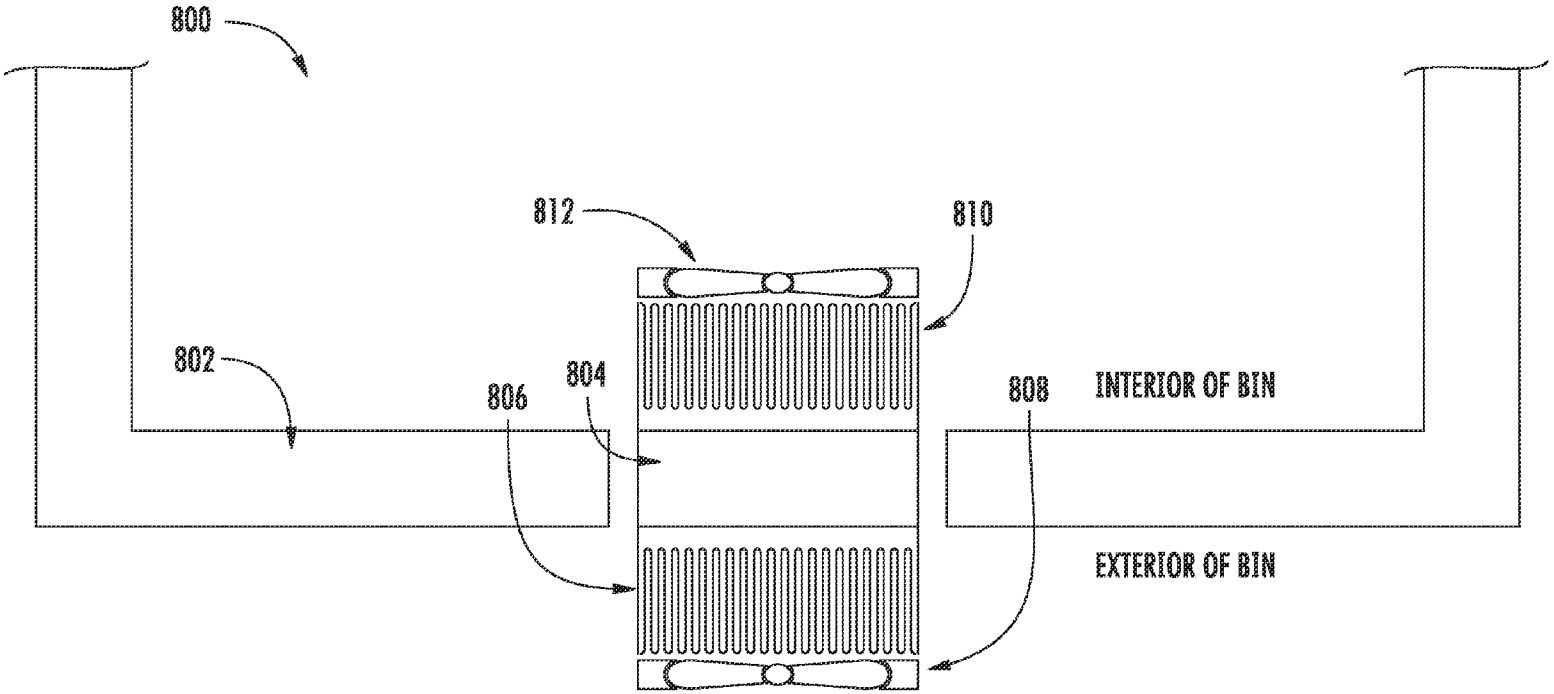
FIG. 8 depicts an example bin according to an example embodiment of the present disclosure.

As an example, FIG. 8 depicts an example bin 800 according to an example embodiment of the present disclosure. A body of bin 800 can be formed from a plurality of walls, such as wall 802. The walls can define a bin storage volume. Wall 802 can be a rear wall, side wall, bottom wall (e.g. floor), etc.

A thermoelectric heat pump 804 can be embedded within or form a portion of wall 802. An exterior heat sink 806 can be positioned adjacent to heat pump 804 at an exterior side of the wall 802. An exterior fan 808 can be positioned adjacent to the exterior heat sink 806. Likewise, an interior heat sink 810 can be positioned adjacent to heat pump 804 at an interior side of the wall 802. An interior fan 812 can be positioned adjacent to the interior heat sink 810. Heat sinks 806 and 810 and fans 808 and 812 can be positioned and operated so as to provide improved heat transfer by the heat pump 804.

As an example, in some embodiments, one or both of fans 808 and 812 can be powered or otherwise operated in unison with the heat pump 804. In some embodiments, the fans 808 and 812 can be respectively mounted directly to the heat sinks 806 and 810. In some embodiments, the direction of rotation of the fans can be immaterial. Therefore, in such embodiments, fans 808 and 812 can powered with arbitrary polarity (e.g. bi-directional) and can be wired together in parallel with the heat pump. Thus, in such embodiments, regardless of whether the heat pump is being operated in the heating mode or the cooling mode, the fans 808 and 812 will provide airflow for improved heat transfer.

Figure 3:
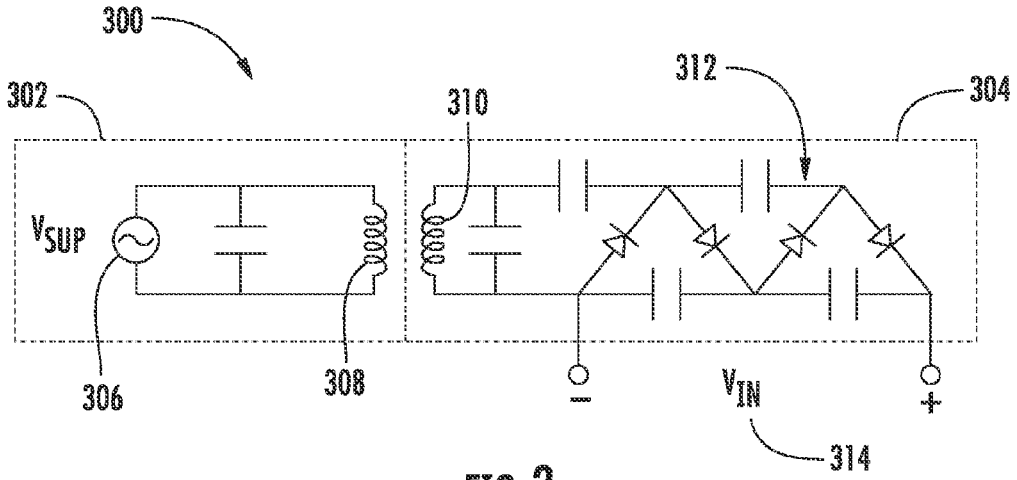
FIG. 3 depicts an example inductive power transfer circuit according to an example embodiment of the present disclosure.

FIG. 3 depicts an example inductive power transfer circuit 300 according to an example embodiment of the present disclosure. In particular inductive power transfer circuit can include a transmitter coil assembly 302 and a receiver coil assembly 304. Transmitter coil assembly 302 can be, for example, embedded within a rear wall of a refrigerator appliance. The receiver coil assembly 304 can be included within a bin positioned inside the refrigerator appliance.

The transmitter coil assembly 302 can include alternating current power source 306 and a transmitter coil 308. Application of alternating current from power source 306 across transmitter coil 308 can generate a magnetic field. The magnetic field can induce a current upon a receiver coil 310 of the receiver coil assembly 304. In such fashion, power can be wirelessly transferred from the transmitter coil assembly 302 to the receiver coil assembly 304.

The power received by receiver coil 310 can be transformed by a rectifier (generally 312) into a direct current power signal. In particular, a direct current voltage ($V_{IN}$) 314 can be used to selectively power other electronic components included within the bin, including, for example, a thermoelectric heat pump.

Figure 4:
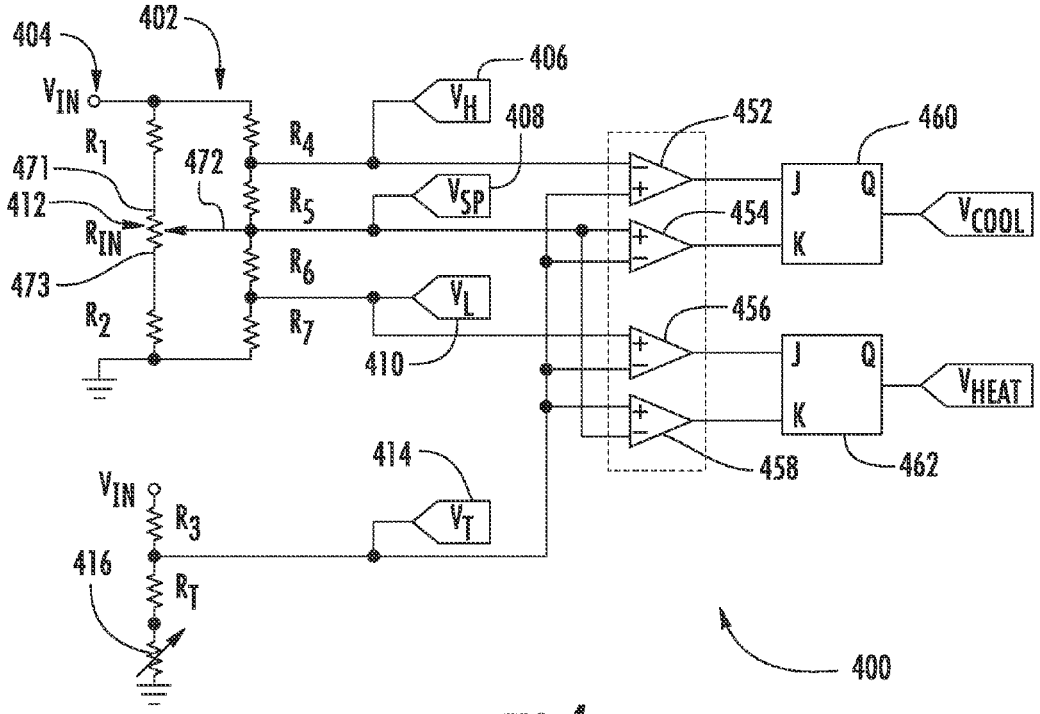
FIG. 4 depicts an example portion of heat pump control circuit according to an example embodiment of the present disclosure.

FIG. 4 depicts an example portion 400 of heat pump control circuit according to an example embodiment of the present disclosure. In particular, the heat pump control circuit can include a voltage divider circuit (generally 402) that divides an input voltage ($V_{IN}$) 404 into a first "high" voltage 406 ($V_H$), a second "setpoint" voltage 408 ($V_{SP}$), and a third "low" voltage 410 ($V_L$). The first, second, and third voltages 406, 408, and 410 can respectively correspond to or otherwise impact a maximum temperature, a setpoint temperature, and a minimum temperature.

In particular, the voltage divider circuit 402 can include a potentiometer 412. The potentiometer 412 can provide resistances that are adjustable. In particular, resistances between a first terminal 471 and a wiper 472 and between the wiper 472 and a second terminal 473 of the potentiometer can be adjustable. Such resistances provided by the potentiometer 412 can be adjusted by a user (e.g. by manipulating or otherwise interacting with a temperature control device such as a knob).

By adjusting the respective resistances provided by potentiometer 412 between the wiper 472 and its terminals 471 and 473, a setpoint temperature associated with the bin can be adjusted. More particularly, by adjusting the respective resistances provided by potentiometer 412 between the wiper 472 and its terminals 471 and 473, each of the voltages 406, 408, and 410 can be adjusted. As will be discussed further below, operation of a thermoelectric heat pump included in the bin can be control based at least in part on the voltages 406, 408, and 410. Thus, adjustment of potentiometer 412 can result in changing the control parameters of the thermoelectric heat pump.

In other embodiments of the present disclosure, various other adjustable resistance devices (e.g. variable resistors) can be used in place of the potentiometer 412 or can be used in various other circuit configurations to provide adjustable setpoint temperature control for a thermoelectric heat pump. Furthermore, in some embodiments, potentiometer 412 can be implemented using plural devices instead of a single device as illustrated. In yet further embodiments, a digital potentiometer can be used.

The heat pump control circuit can also include a comparison circuit (generally 450). The comparison circuit can compare a fourth voltage 414 ($V_T$) across a thermistor 416 to each of the first, second, and third voltages 406, 408, and 410 to provide an output. The output can indicate whether the thermoelectric heat pump should be operated in the heating mode, the cooling mode, or neither the heating mode nor the cooling mode.

As an example, the comparison circuit can include a first operational amplifier 452, a second operational amplifier 454, a third operational amplifier 456, and a fourth operational amplifier 458. For example, operational amplifiers 452-458 can be Schmitt trigger operational amplifiers, various forms of comparators, or other operational amplifiers.

The first operational amplifier 452 can compare the first voltage 406 ($V_H$) to the fourth voltage 414 ($V_T$). The output of the first operational amplifier 452 can be provided to a J input of a first flip-flop 460. The output of the second operational amplifier 454 can be provided to a K input of the first flip-flop 460. The output of the third operational amplifier 456 can be provided to a J input of a second flip-flop 462. The output of the fourth operational amplifier 458 can be provided to a K input of the second flip-flop 462.

The Q output of the first flip-flop 460 can be a signal ($V_{COOL}$) that indicates when the thermoelectric heat pump should be operated in the cooling mode. The Q output of the second flip-flop 462 can be a signal ($V_{HEAT}$) that indicates when the thermoelectric heat pump should be operated in the heating mode.

Figure 5:
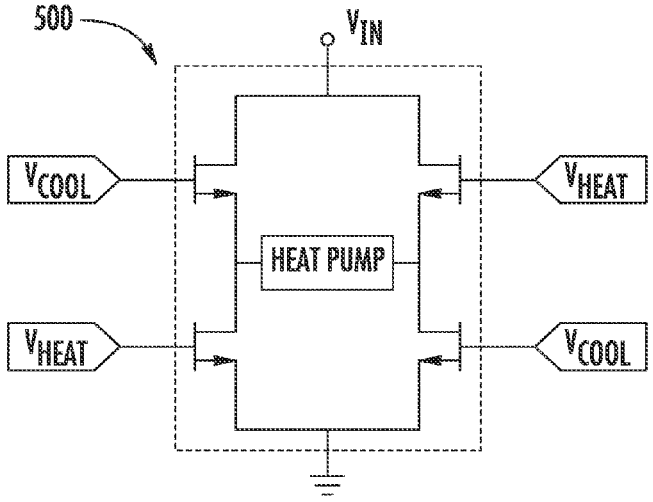
FIG. 5 depicts an example portion of heat pump control circuit according to an example embodiment of the present disclosure.

FIG. 5 depicts an example portion 500 of heat pump control circuit according to an example embodiment of the present disclosure. In particular, portion 500 includes an H-bridge driver circuit that drives the thermoelectric heat pump in the heating mode, the cooling mode, or neither the heating mode nor the cooling mode based on the output of the comparison circuit.

In particular, when the $V_{COOL}$ signal is high (e.g. greater than zero) and the $V_{HEAT}$ signal is low (e.g. at or around zero) then the heat pump can be driven (e.g. operated) in the cooling mode. Likewise, when the $V_{HEAT}$ signal is high (e.g. greater than zero) and the $V_{COOL}$ signal is low (e.g. at or around zero) then the heat pump can be driven (e.g. operated) in the heating mode.

Figure 6:
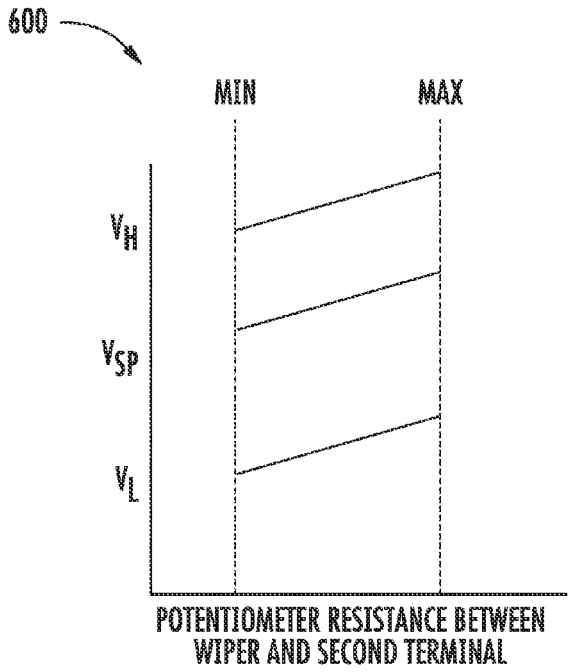
FIG. 6 depicts a graph of example control voltages versus potentiometer resistance according to an example embodiment of the present disclosure.

FIG. 6 depicts a graph 600 of example control voltages versus potentiometer resistance according to an example embodiment of the present disclosure. As indicated by graph 600, as the resistance provided by the potentiometer between the wiper and the second terminal increases, the first, second, and third voltages increase as well. The voltages are bounded by the limits of available resistances to be provided by the potentiometer. Thus, the potentiometer and other resistors or components included within the heat pump control circuit can be selected such that the range of control voltages (e.g. $V_{SP}$) that may possibly be generated by the full electrical range of the potentiometer (or other adjustable resistance device) is equivalent or otherwise related to a range of voltages generated by a thermistor that correspond to temperatures that bound or include the range of optimal temperatures for storage of the majority of common food items.

In the embodiment to which graph 600 corresponds, the thermistor is a positive temperature coefficient thermistor. In other embodiments, a negative temperature coefficient thermistor can be used instead (e.g. by interchanging the positions of $R_T$ and $R_3$ in FIG. 4, interchanging the inputs of the flip-flops, or other circuit variations).

Figure 7:
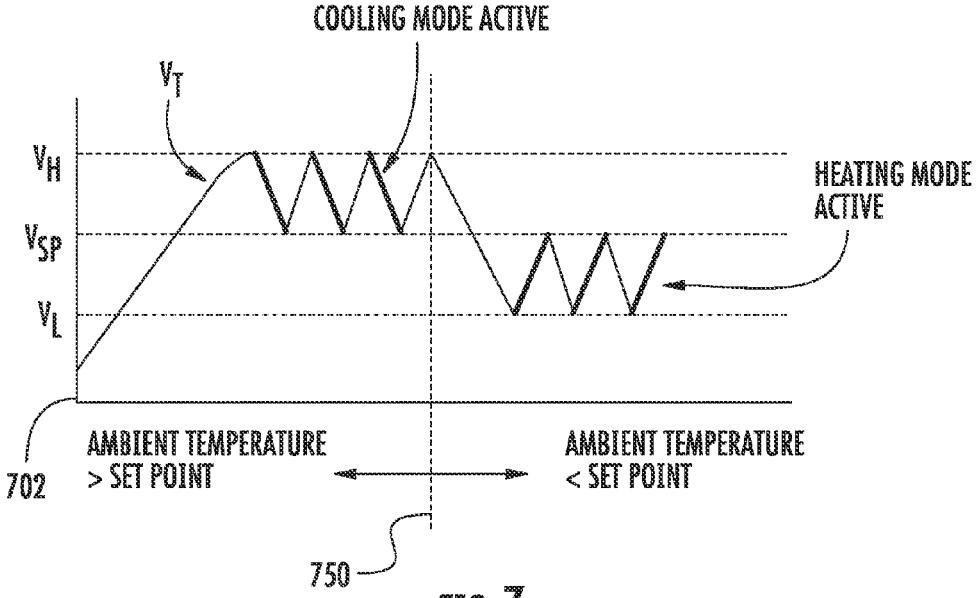
FIG. 7 depicts a diagram of example heat pump operational behavior according to an example embodiment of the present disclosure.

FIG. 7 depicts a diagram 700 of example heat pump operational behavior according to an example embodiment of the present disclosure. In particular, diagram 700 depicts the voltage across a thermistor ($V_T$) changing over time. More particularly, prior to time 750 the ambient temperature surrounding the bin is greater than a setpoint temperature associated with the bin. After time 750 the ambient temperature surrounding the bin is less than a setpoint temperature associated with the bin.

At time 702 the thermistor voltage ($V_T$) increases as the temperature in the bin increases. When the thermistor voltage ($V_T$) reaches a high voltage ($V_H$) associated with a maximum temperature, the heat pump is operated in a cooling mode, thereby reducing the temperature within the bin until the thermistor voltage ($V_T$) reaches a setpoint voltage ($V_{SP}$) associated with a setpoint temperature. This cycle repeats three times. In particular, bolded portions of the thermistor voltage signal indicate when the heat pump is operating.

At time 750 the ambient temperature surrounding the bin transitions to being less than the setpoint temperature associated with the bin. For example, the refrigeration system of the refrigerator appliance may resume operating at (750) to cool the ambient space.

As a result, the temperature in the bin reduces until the thermistor voltage ($V_T$) reaches a low voltage ($V_L$) associated with a minimum temperature. When the thermistor voltage ($V_T$) reaches a low voltage ($V_L$), the heat pump is operated in a heating mode, thereby increasing the temperature within the bin until the thermistor voltage ($V_T$) reaches a setpoint voltage ($V_{SP}$) associated with a setpoint temperature. This cycle repeats three times.

In such fashion, the temperature within the bin may be maintained at or near the setpoint temperature. In particular, the temperature within the bin can be maintained within a range of temperatures between the minimum and maximum temperatures respectively corresponding to $V_L$ and $V_H$. As discussed above, in some embodiments, the control voltages can be adjusted (e.g. by the user) by adjusting a resistance provided by a potentiometer or other adjustable resistance device. Therefore, each bin can be individually temperature controlled and maintained at different, adjustable temperatures which may be optimized for certain food items.

Furthermore, because the bin electronics (e.g. heat pump and control circuitry) are wirelessly powered through inductive power transfer, the bins can be movable to different spaces within the refrigerator at which a transmitter coil is located. Thus, the bins and associated refrigerator appliances of the present disclosure can provide enhanced user customizability of refrigerator layout and modular temperature control.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

In particular, the particular circuits provided by the present disclosure and illustrated in the drawings (including FIGS. 3, 4, and 5) are provided as example circuits that can be used to accomplish aspects of the present disclosure. The present disclosure is not limited to the particular example circuit designs provided. One of skill in the art will understand that due to the flexibility of electrical circuitry and associated components, many different circuits may be devised to accomplish the present disclosure. For example, although FIG. 4 shows the use of a potentiometer to allow adjustment of the control voltages, other adjustable resistance devices can be used to alter the division of the input voltage. Many other variations to the example circuits provided herein can be made as well while remaining within the scope of the present disclosure.

What is claimed is:

1. A bin for use in a refrigerator appliance, the bin comprising:

a bin body, wherein the bin body defines a bin storage volume;

an adjustable resistance device, wherein the adjustable resistance device provides a first resistance that is adjustable to adjust a setpoint temperature associated with the bin;

a thermistor positioned within the bin storage volume, wherein the thermistor provides a second resistance indicative of a temperature in the bin storage volume;

a receiver coil, wherein the receiver coil is configured to receive power through inductive power transfer from a transmitter coil included in the refrigerator appliance; and a thermoelectric heat pump, wherein the thermoelectric heat pump receives power from the receiver coil;

a heat pump control circuit configured to control operation of the thermoelectric heat pump in either a heating mode or a cooling mode based, at least in part, on the first resistance and the second resistance, the heat pump comprising:

a voltage divider circuit configured to divide an input voltage to provide a first, second, and third voltage that respectively correspond to a maximum temperature, the setpoint temperature, and a minimum temperature; and a comparison circuit configured to compare a fourth voltage across the thermistor to each of the first, second, and third voltages to provide an output indicative of whether the thermoelectric heat pump should be operated in the heating mode, the cooling mode, or neither the heating mode nor the cooling mode, the comparison circuit comprising:

a first operational amplifier that compares the fourth voltage to the first voltage;

a second operational amplifier that compares the fourth voltage to the second voltage;

a third operational amplifier that compares the fourth voltage to the third voltage;

a fourth operational amplifier that compares the fourth voltage to the second voltage;

a first flip-flop that respectively receives signals output by the first and second operational amplifiers, wherein a high signal from the first flip-flop indicates that the thermoelectric heat pump should be operated in the cooling mode; and a second flip-flop that respectively receives signals output by the third and fourth operational amplifiers, wherein a high signal from the second flip-flop indicates that the thermoelectric heat pump should be operated in the heating mode.

2. The bin of claim 1, wherein the heat pump control circuit further comprises:

an H-bridge driver circuit, wherein the H-bridge driver circuit drives the thermoelectric heat pump in the heating mode, the cooling mode, or neither the heating mode nor the cooling mode based on the output of the comparison circuit.

3. The bin of claim 1, further comprising a control device that allows a user to adjust the first resistance provided by the adjustable resistance device and thereby adjust the setpoint temperature associated with the bin, wherein the control device is located on an exterior surface of the bin body.

4. The bin of claim 1, wherein:

the bin body comprises a plurality of panels that define the bin storage volume; and the thermoelectric heat pump is included in one of the plurality of panels.

* * * * *